US007578580B2

(12) United States Patent
Ito et al.

(10) Patent No.: US 7,578,580 B2
(45) Date of Patent: Aug. 25, 2009

(54) INKJET HEAD WITH CONDUCTIVE ELASTIC MEMBER FOR ELECTRICAL CONTINUITY BETWEEN REMOTE CONTACTS IN SAME

(75) Inventors: Atsushi Ito, Nagoya (JP); Yasuhiro Kato, Nagoya (JP); Naoya Okazaki, Gifu-ken (JP); Masayuki Takata, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 465 days.

(21) Appl. No.: 11/236,085

(22) Filed: Sep. 27, 2005

(65) Prior Publication Data

US 2006/0066675 A1 Mar. 30, 2006

(30) Foreign Application Priority Data

Sep. 27, 2004 (JP) ..... 2004-279396

(51) Int. Cl.
*B41J 2/16* (2006.01)
*B41J 2/05* (2006.01)

(52) U.S. Cl. ..... 347/50; 347/57

(58) Field of Classification Search ..... 347/20, 347/50, 85, 104
See application file for complete search history.

(56) References Cited

U.S. PATENT DOCUMENTS 4,068,204 A * 1/1978 Iwanari et al. ..... 337/408
6,550,902 B2 * 4/2003 Shinada et al. ..... 347/86
6,692,106 B2 * 2/2004 Aizawa et al. ..... 347/46
7,044,578 B2 * 5/2006 Owaki et al. ..... 347/27
7,057,406 B2 * 6/2006 Chang et al. ..... 324/754
7,192,286 B2 * 3/2007 An et al. ..... 439/55
7,252,369 B2 * 8/2007 Nakamura et al. ..... 347/65
2002/0013094 A1 * 1/2002 Jones et al. ..... 439/625
2003/0160841 A1 * 8/2003 Takata et al. ..... 347/50
2004/0109041 A1 * 6/2004 Owaki et al. ..... 347/20

FOREIGN PATENT DOCUMENTS

JP 63281877 11/1988
JP 4260398 9/1992

* cited by examiner

*Primary Examiner*—Stephen D Meier
*Assistant Examiner*—Kar Yip
(74) *Attorney, Agent, or Firm*—Reed Smith LLP

(57) ABSTRACT

An inkjet head for ejecting ink droplets is disclosed which includes: a nozzle unit having metal thin plates and a piezoelectric device, adapted to eject the ink droplets; a printed circuit board supplying to the piezoelectric device a drive signal for causing the nozzle unit to eject the ink droplets; a support supporting the nozzle unit and the printed circuit board in opposing relationship to each other; an earth contact disposed on the nozzle unit; a ground contact disposed on the printed circuit board, held at a reference potential; an electrically conductive elastic member disposed between the earth and ground contacts, such that portions of the elastic member are in electrical contact with the earth and ground contacts, respectively; and a movement limiter limiting movement of the elastic member to thereby prevent the elastic member from being disengaged from the earth and ground contacts.

24 Claims, 12 Drawing Sheets

INKJET HEAD WITH CONDUCTIVE ELASTIC MEMBER FOR ELECTRICAL CONTINUITY BETWEEN REMOTE CONTACTS IN SAME

This application is based on Japanese Patent Application No. 2004-279396 filed Sep. 27, 2004, the content of which is incorporated hereinto by reference.

CROSS-REFERENCE TO RELATED APPLICATIONS

Not Applicable.

BACKGROUND OF THE INVENTION

1. Field of the Invention

The invention relates to an inkjet head for use in an inkjet printer, and more particularly to techniques of achieving electrical continuity between remote contacts in the inkjet head.

2. Description of the Related Art

There are known inkjet heads for use in inkjet printers, which each incorporate a nozzle unit including a plurality of metal thin plates and a piezoelectric device. During a print operation of such a kind of inkjet head, drive signals are delivered to the piezoelectric device for ejecting ink droplets through nozzles contained in the nozzle unit, resulting in the formation of the desired image on a print medium.

More specifically, such a type of inkjet head is structured such that the piezoelectric device is affixed to a cavity unit comprised of the plurality of metal thin plates. In the thus-structured inkjet head, the nozzle unit and a support to which the nozzle unit is attached are each electrically held at a reference potential (e.g., a ground or earth potential).

The failure to electrically hold these nozzle unit and support at the reference potential invites an event of charging ink within the nozzle unit. If the ink is charged, then the piezoelectric device is chemically attacked (chemical erosion and corrosion occur in the piezoelectric device) due to the action of ionic compound in the ink, or the like. This creates the fear that the piezoelectric device will be deteriorated in quality in a shortened time of use.

For these reasons, a conventional inkjet head of such a type is used such that the cavity unit to which the piezoelectric device has been attached is grounded using silver paste. However, this constitutes one of factors causing an increase in cost.

It is known to use a coil spring as a part of electrical wiring, as disclosed in Japanese Patent Application Publications No. Sho 63-281877 and No. Hei 4-260398, for example.

More specifically, the above Publication No. Sho 63-281877 discloses an inkjet print apparatus in which a coil spring provides electrical continuity between a grounding member electrically connected with a metal component contained in a head unit (nozzle unit), and a metal base frame, and also protection of ink delivery tubing extending from an ink tank to the head unit containing the metal component.

BRIEF SUMMARY OF THE INVENTION

Where an inkjet head is configured such that a head unit and a printed circuit board adapted to drive the head unit are disposed close to each other, two techniques can be employed for rendering each of the electrical potential of an earth contact of the head unit and the electrical potential of a ground contact of the printed circuit board equal to a reference potential.

The first technique is, for individual electrical continuity with a common grounding area having the reference potential, to connect the head unit (precisely, its earth contact) and the printed circuit board (precisely, its ground contact), respectively, to the common grounding area, via separate conductive wires. The second technique is, on the other hand, to directly interconnect the head unit and the printed circuit board via a conductive wire.

When compared with these two techniques with respect to the easiness to simplify the construction of related circuitry, the second technique is more advantageous than the first technique.

The reason for the above is that, when the head unit and the printed circuit board are directly interconnected via a conductive wire, mere connection of even any one of the head unit and the printed circuit board to the common grounding area having the reference potential renders the potential of each of these head unit and printed circuit board equal to the same reference potential.

When the head unit and the printed circuit board are directly interconnected via a conductive wire, there arises the need of assuring reliability of electrical continuity at each of a connection site between the head unit and one end of the conductive wire, and a connection site between the printed circuit board and the other end of the conductive wire.

Therefore, it is conventional to manufacture an inkjet head by electrically and mechanically fixedly connecting the head unit and the conductive wire to each other, and by electrically and mechanically fixedly connecting the printed circuit board and the conductive wire to each other.

For this reason, the above conventional approach, i.e., electrical interconnection of the head unit and the printed circuit board via the conductive wire, requires the process of mechanically fixedly connecting performed at each connection site, constituting one of factors causing a decrease in manufacturing efficiency.

It is therefore an object of the present invention to provide an inkjet head including a nozzle unit and a printed circuit board, in which electrical continuity between these nozzle unit and printed circuit board can be achieved without requiring the process of mechanically fixedly connecting performed at each connection site.

According to the present invention, an inkjet head for ejecting ink droplets in an inkjet manner is provided.

This inkjet head includes:

a nozzle unit having a plurality of metal thin plates and a piezoelectric device, adapted to eject the ink droplets;

a printed circuit board supplying to the piezoelectric device a drive signal for causing the nozzle unit to eject the ink droplets;

a support supporting the nozzle unit and the printed circuit board in opposing relationship to each other;

an earth contact disposed on the nozzle unit; and a ground contact disposed on the printed circuit board, held at a reference potential.

This inkjet head further includes:

an electrically conductive elastic member disposed between the earth contact and the ground contact, such that a first portion of the elastic member electrically contacts the earth contact, while a second portion of the elastic member electrically contacts the ground contact; and a movement limiter limiting movement of the elastic member to thereby prevent the elastic member from being disengaged from the earth contact and the ground contact.

This inkjet head is structured such that the electrically conductive elastic member or material is interposed between the earth contact of the nozzle unit and the ground contact of the printed circuit board both disposed in opposing relationship. As a result, these earth and ground contacts are rendered electrically conductive engagement with each other via the electrically conductive elastic member.

In this inkjet head, the ground contact is electrically held at the reference potential, and therefore, once the earth contact is rendered electrically conductive engagement with the ground contact via the elastic member, the earth contact is also electrically held at the same reference potential.

Further, in this inkjet head, the movement limiter limits the movement of the elastic member in a direction allowing the elastic member to be disengaged from the earth and ground contacts. Accordingly, the elastic member is prevented from being disengaged from the earth and ground contacts. As a result, the reliability of electrical continuity is assured between the earth and ground contacts.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
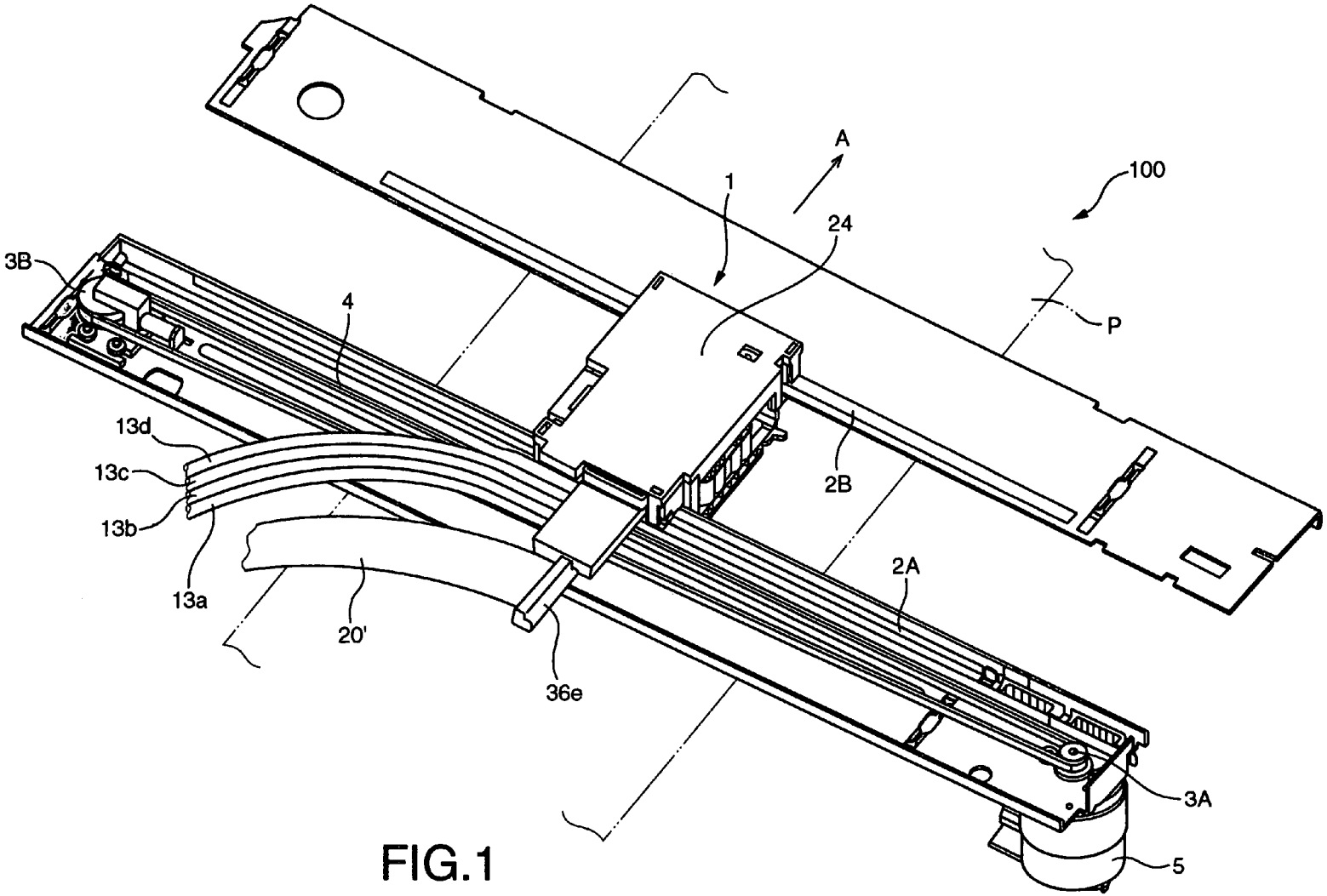
FIG. 1 is a sectional view illustrating relevant components of a printer including an inkjet head constructed according to a first embodiment of the present invention.

The object mentioned above may be achieved according to any one of the following modes of this invention.

These modes will be stated below so as to be sectioned and numbered, and so as to depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the modes of the invention in such a dependent form as to depend from the other mode or modes does not exclude the possibility that the technological features set forth in a dependent-form mode become independent of those set forth in the corresponding depended mode or modes and to be removed therefrom. It should be interpreted that the technological features set forth in a dependent-form mode is allowed to become independent, where appropriate.

(1) An inkjet head for ejecting ink droplets in an inkjet manner, including:

a nozzle unit having a plurality of metal thin plates and a piezoelectric device, adapted to eject the ink droplets;

a printed circuit board supplying to the piezoelectric device a drive signal for causing the nozzle unit to eject the ink droplets;

a support supporting the nozzle unit and the printed circuit board in opposing relationship to each other;

an earth contact disposed on the nozzle unit;

a ground contact disposed on the printed circuit board, held at a reference potential;

an electrically conductive elastic member disposed between the earth contact and the ground contact, such that a first portion of the elastic member electrically contacts the earth contact, while a second portion of the elastic member electrically contacts the ground contact; and a movement limiter limiting movement of the elastic member, to thereby prevent the elastic member from being disengaged from the earth and ground contacts.

In the inkjet head according to the above mode (1), the electrically conductive elastic member or material is interposed between the earth contact of the nozzle unit and the ground contact of the printed circuit board both disposed in opposing relationship. As a result, these earth and ground contacts are rendered electrically conductive engagement with each other via the electrically conductive elastic member.

In the inkjet head according to the above mode (1), the ground contact is electrically held at the reference potential, and therefore, once the earth contact is rendered electrically conductive engagement with the ground contact via the elastic member, the earth contact is also electrically held at the same reference potential.

In the inkjet head according to the above mode (1), the earth contact and the first portion of the elastic member are not mechanically fixedly connected to each other, and similarly, the ground contact and the second portion of the elastic member are not mechanically fixedly connected to each other.

As a result, the inkjet head according to the above mode (1) allows electrical continuity between the earth and ground contacts using the electrically conductive elastic member, without requiring the process of mechanically fixedly connecting performed at each of connection sites between the earth contact and the elastic member and between the ground contact and the elastic member.

As described above, in the inkjet head according to the above mode (1), the earth contact of the nozzle unit and the ground contact of the printed circuit board are connected to the first and second portions of the electrically conductive elastic member, in a relatively displaceable manner, respectively.

Due to this, if the elastic member moves in a direction (for example, lateral direction) intersecting a direction in which the earth and ground contacts are opposed to each other, then the elastic member is possibly disengaged from at least one of the earth and ground contacts. The disengagement of the elastic member from at least one of the earth and ground contacts renders the elastic member into non-contact with the at least one of the earth and ground contacts, resulting in the termination of the electrical continuity between the earth and ground contacts.

However, the inkjet head according to the above mode (1) prevents, by the movement limiter, the elastic member from being moved in a direction causing the above disengagement, to thereby prevent the elastic member from being disengaged from the earth and ground contacts. As a result, the reliability of electrical continuity is assured between the earth and ground contacts.

(2) The inkjet head according to mode (1), wherein the movement limiter mechanically engages with at least one of the first and second portions of the elastic member, to thereby suppress movement of the elastic member away from a predetermined normal position thereof.

The inkjet head according to the above mode (2) provides a specific example of the movement limiter set forth in the above mode (1). In this specific example, the movement limiter is mechanically engaged with at least one of the first and second portions of the elastic member, to thereby restrict the movement of the elastic member away from its predetermined normal position.

(3) The inkjet head according to mode (1) or (2), wherein the elastic member is detachably attached to the earth and ground contacts in electrical contact therewith, with the elastic member being interposed between the earth and ground contacts.

The inkjet head according to the above mode (3) provides a specific example of the scheme for supporting the elastic member set forth in the above mode (1). In this specific example, the elastic member is detachably attached to the earth and ground contacts.

(4) The inkjet head according to any one of modes (1)-(3), wherein the elastic member is in electrical contact with the earth and ground contacts with the elastic member being compressed between and by the earth and ground contacts.

The inkjet head according to the above mode (4) provides an alternative specific example of the scheme for supporting the elastic member set forth in the above mode (1). In this specific example, the elastic member is in electrical contact with the earth and ground contacts with the elastic member being compressed between and by the earth and ground contacts.

As a result, the inkjet head according to the above mode (4) achieves persistent electrical connection between the earth contact of the nozzle unit and the first portion of the elastic member because of the compressive force of the elastic member, and also achieves persistent electrical connection between the ground contact of the printed circuit board and the second portion of the elastic member because of the compressive force of the elastic member.

(5) The inkjet head according to any one of modes (1)-(4), wherein the earth contact includes an electrically conductive fixture for fixing the nozzle unit to the support.

The inkjet head according to the above mode (5) allows the utilization of the electrically conductive fixture for fixing the nozzle unit to the support, for the purpose of forming the earth contact of the nozzle unit, without using a separate special member for the purpose.

(6) The inkjet head according to any one of modes (1)-(5), wherein the elastic member includes a coil spring, the coil spring having two opposite ends, at one of which the coil spring is pressed against the earth contact for electrical contact therewith, and at the other of which the coil spring is pressed against the ground contact for electrical contact therewith.

In the inkjet head according to the above mode (6), the electrically conductive elastic member is interposed between the earth contact of the nozzle unit and the ground contact of the printed circuit board, which are opposed to each other. Due to this, the earth contact of the nozzle unit is electrically connected with the ground contact (which is electrically held at the reference potential) of the printed circuit board via the electrically conductive coil spring.

The lateral movement of the coil spring is limited by the movement limiter. As a result, disengagement of the coil spring from at least one of the earth and ground contacts is prevented, and therefore, the earth and ground contacts are avoided from being brought into non-contact with the coil spring.

In this context, the "electrically conductive coil spring" means a coil spring made of an electrically conductive metal wire material, for example.

(7) The inkjet head according to mode (6), wherein the movement limiter mechanically engages with at least one of the two opposite ends of the coil spring, to thereby suppress movement of the coil spring away from a predetermined normal position thereof.

The inkjet head according to the above mode (7) provides a specific example of the structure of the movement limiter in the case where the elastic member set forth in the above mode (1) is the coil spring.

In this specific example, the movement limiter mechanically engages with at least one of the two opposite ends of the coil spring, to thereby suppress the movement of the coil spring away from the predetermined normal position.

(8) The inkjet head according to mode (7), wherein the movement limiter includes an earth-contact-side member disposed at or near the earth contact for limiting movement of the one end of the coil spring.

The inkjet head according to the above mode (8) prevents, by the earth-contact-side member, the one end of the coil spring from being moved away and disengaged from the earth contact of the nozzle unit.

(9) The inkjet head according to mode (8), wherein the earth-contact-side member includes a first cylindrical member into which the one end of the coil spring is inserted.

In the inkjet head according to the above mode (9), the one end of the coil spring is retained by inserting the one end into the first cylindrical member, and as a result, the first cylindrical member prevents the one end of the coil spring from being moved away and disengaged from the earth contact of the nozzle unit.

Therefore, the inkjet head according to the above mode (9), because allows the first cylindrical member to retain the one end (on the side of the earth contact) of the coil spring, inhibits the unwanted lateral movement of the one end of the coil spring. As a result, disengagement of the one end of the coil spring from the earth contact is prevented, and eventually the coil spring is prevented from being brought into non-contact with the earth contact.

The first cylindrical member may be embodied such that the first cylindrical member is disposed directly onto the earth contact of the nozzle unit, or may be alternatively embodied such that the first cylindrical member is supported by a member other than the earth contact, so as to be located at or near the earth contact.

In layout, the first cylindrical member, with no contact with the earth contact required, may be located so as to leave a clearance between the first cylindrical member and the earth contact.

(10) The inkjet head according to mode (9), wherein the first cylindrical member is electrically insulative.

(11) The inkjet head according to mode (9) or (10), wherein the earth contact is in the form of a projection on a flat plane of the nozzle unit, the coil spring is sized to have substantially the same outer dimension as that of the projection, and is disposed to extend between the projection and the ground contact along a straight line passing through the projection, and the inkjet head further includes a guide externally fitted with the first cylindrical member, the guide being disposed on the flat plane so as to extend substantially coaxially with the straight line, and so as to externally and laterally surround the projection.

(12) The inkjet head according to any one of modes (7)-(11), wherein the movement limiter includes a ground-contact-side member disposed at or near the ground contact for limiting movement of the other end of the coil spring.

The inkjet head according to the above mode (12) prevents, by the ground-contact-side member, the other end of the coil spring from being moved away and disengaged from the ground contact of the printed circuit board.

(13) The inkjet head according to mode (12), wherein the ground-contact-side member includes a recessed portion formed in the ground contact into which the other end of the coil spring is fitted.

In the inkjet head according to the above mode (13), the other end of the coil spring is retained by inserting the other end of the coil spring into the recessed portion, and as a result, the recessed portion prevents the other end of the coil spring from being moved away and disengaged from the ground contact of the printed circuit board.

Therefore, the inkjet head according to the above mode (13), because allows the recessed portion to retain the other end (on the side of the ground contact) of the coil spring, inhibits lateral movement of the other end of the coil spring. As a result, disengagement of the other end of the coil spring from the ground contact is prevented, and eventually the coil spring is prevented from being brought into non-contact with the ground contact.

In the inkjet head according to the above mode (13), the recessed portion is formed in the ground contact of the printed circuit board, and the other end of the coil spring is inserted or fitted into the recessed portion, to thereby prevent the lateral movement of the other end of the coil spring. The recessed portion may be formed in the ground contact of the printed circuit board so as to have a simplified construction.

(14) The inkjet head according to mode (13), wherein the recessed portion is electrically conductive.

In the inkjet head according to the above mode (14), the recessed portion is formed, with electrically conductive material, so as to be shaped to limit the movement of the other end of the coil spring.

Therefore, the inkjet head according to the above mode (14) allows the same recessed portion to achieve the electrical continuity between the other end of the coil spring and the ground contact, and to prevent lateral movement of the other end of the coil spring.

(15) The inkjet head according to mode (14), wherein the recessed portion is constructed by continuous and annular application of electrically conductive material onto the ground contact, so as to accommodate a diameter of the coil spring.

The inkjet head according to the above mode (15), because allows the formation of the recessed portion by continuous and annular application of the electrically conductive material onto the ground contact, so as to accommodate a diameter of the coil spring, enables simplified fabrication of the recessed portion.

(16) The inkjet head according to mode (14), wherein the recessed portion is constructed by non-continuous and annular application of electrically conductive material onto the ground contact, so as to accommodate a diameter of the coil spring.

The inkjet head according to the above mode (16), because allows the formation of the recessed portion by non-continuous and annular application of the electrically conductive material onto the ground contact, so as to accommodate a diameter of the coil spring, enables simplified fabrication of the recessed portion with a reduced amount of the electrically conductive material when compared with when the recessed portion is formed by continuous application of the electrically conductive material.

(17) The inkjet head according to mode (12), wherein the ground-contact-side member includes a projecting portion formed in the ground contact which is fitted into the other end of the coil spring.

In the inkjet head according to the above mode (17), the projecting portion is formed in the ground contact of the printed circuit board, and the projecting portion is inserted or fitted into the other end of the coil spring, to thereby prevent the lateral movement of the other end of the coil spring.

(18) The inkjet head according to mode (17), wherein the projecting portion is electrically conductive.

In the inkjet head according to the above mode (18), the projecting portion is formed, with electrically conductive material, so as to be shaped to limit the movement of the other end of the coil spring.

Therefore, the inkjet head according to the above mode (18) allows the same projecting portion to achieve the electrical continuity between the other end of the coil spring and the ground contact, and to prevent the lateral movement of the other end of the coil spring.

(19) The inkjet head according to any one of modes (7)-(18), wherein the movement limiter includes a second cylindrical member which extends from the vicinity of the earth contact to the vicinity of the ground contact, and into which the coil spring is inserted.

In the inkjet head according to the above mode (19), the coil spring is inserted into the second cylindrical member extending from the vicinity of the earth contact to the vicinity of the ground contact. Therefore, this inkjet head prevents, by the second cylindrical member, lateral movement of at least one end of the coil spring.

As a result, the inkjet head according to the above mode (19) prevents at least one end of the coil spring from being disengaged from at least one of the earth and ground contacts.

(20) The inkjet head according to mode (19), wherein the second cylindrical member is electrically insulative.

Several presently preferred embodiments of the invention will be described in detail by reference to the drawings in which like numerals are used to indicate like elements throughout.

Referring now to FIG. 1, an inkjet head 1 according to a first embodiment of the present invention is illustrated.

Figure 2:
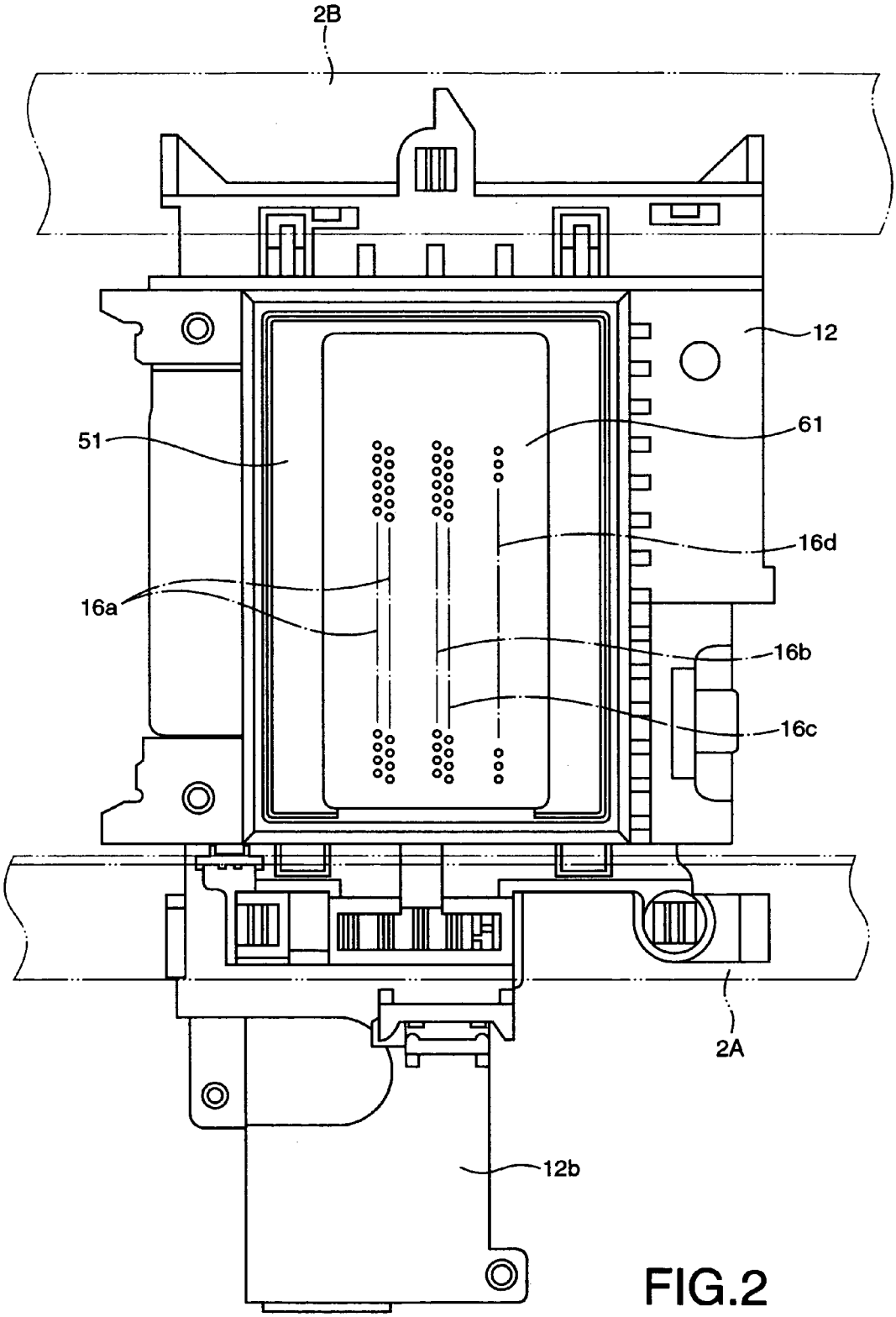
FIG. 2 is an enlarged bottom view illustrating the inkjet head shown in FIG. 1.
Figure 3:
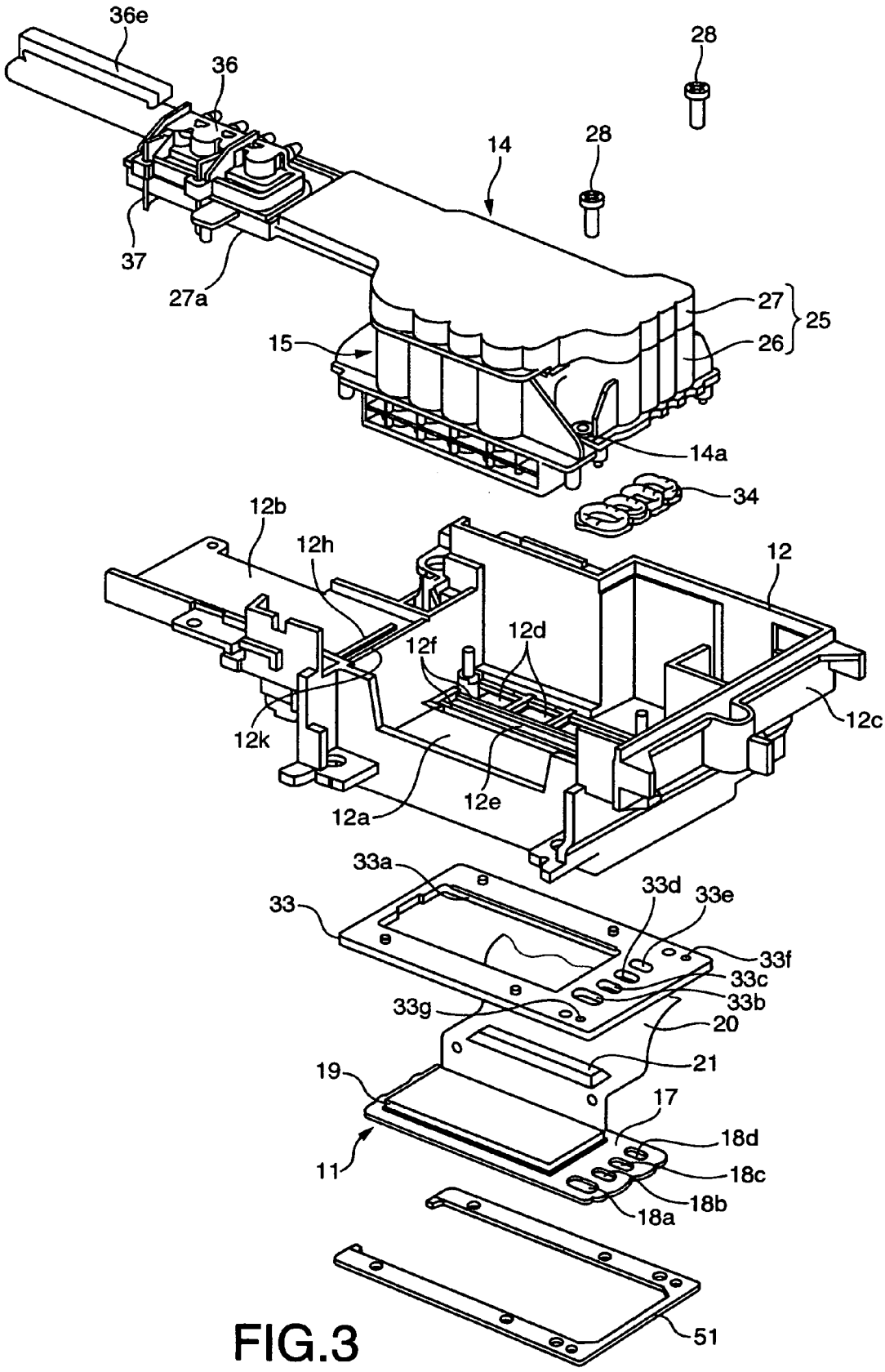
FIG. 3 is an exploded perspective view illustrating the inkjet head shown in FIG. 1.

FIG. 1 is a perspective view illustrating relevant components of an inkjet printer 100 including the inkjet head 1, FIG. 2 is a bottom view illustrating the inkjet head 1, and FIG. 3 is an exploded perspective view illustrating the inkjet head 1.

Figure 4:
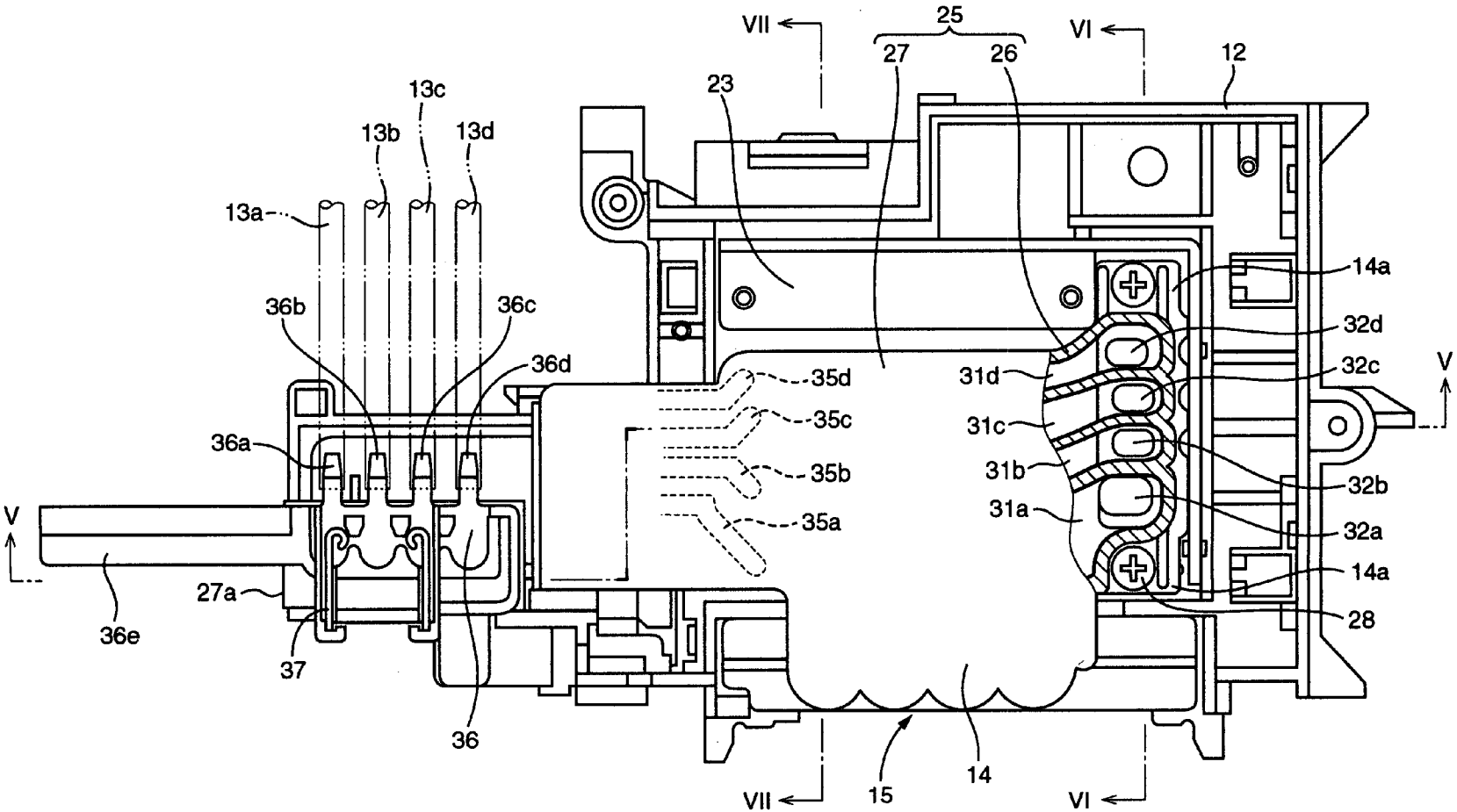
FIG. 4 is a top plan view partly in section illustrating the inkjet head shown in FIG. 1.
Figure 5:
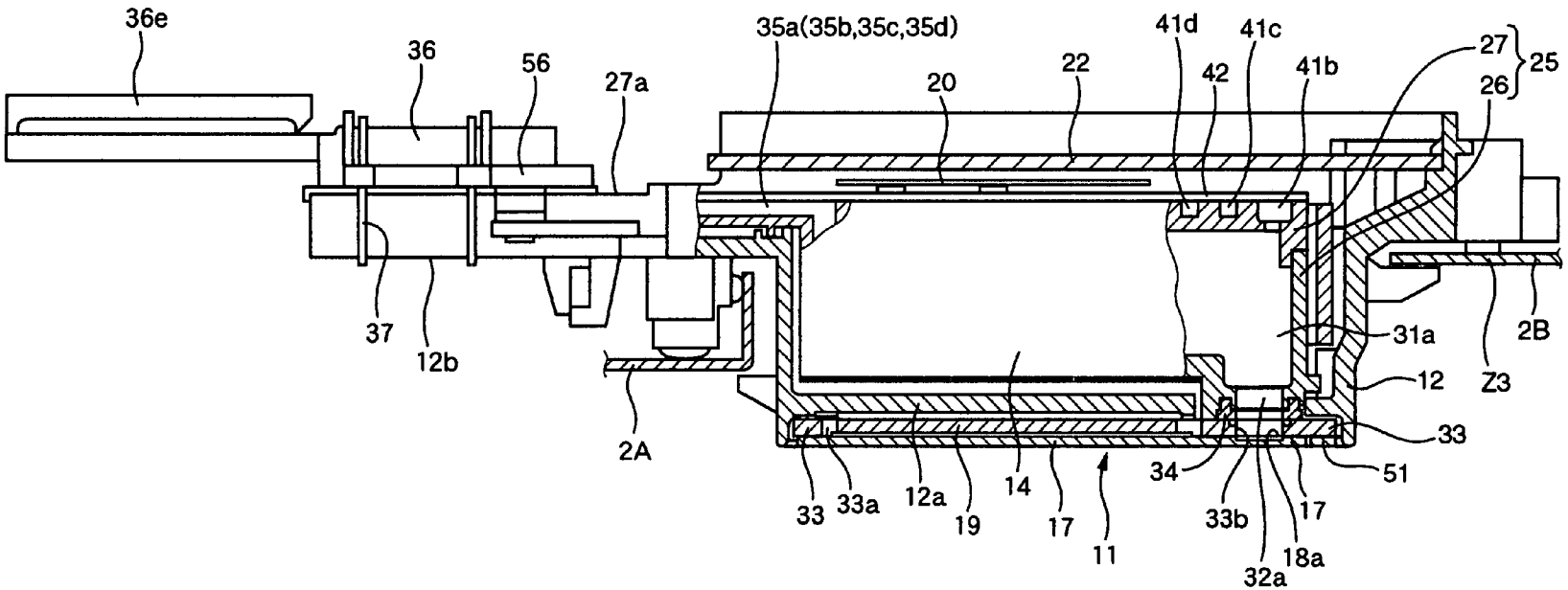
FIG. 5 is a cross sectional view taken on line V-V in FIG. 4.

FIG. 4 is a top plan view partly in section of the inkjet head 1, and FIG. 5 is a cross sectional view taken on line V-V in FIG. 4.

As illustrated in FIG. 1, the inkjet printer 100 includes the inkjet head 1. As illustrated in FIG. 3, the inkjet head 1 includes a thin-plate-shaped nozzle unit 11, and a head holder 12 made of a synthetic resin on which the nozzle unit 11 is mounted. The nozzle unit 11 including a plurality of nozzles is used for ejecting ink droplets through the nozzles in an inkjet manner.

As illustrated in FIG. 1, in the inkjet printer 100, ink is supplied from an ink tank (not shown) via ink supply tubes 13*a*, 13*b*, 13*c*, and 13*d* to a buffer tank 14 for temporary storage therein, illustrated in FIG. 3. As illustrated in FIG. 3, the buffer tank 14 is mounted on the head holder 12. In the inkjet printer 100, ink, after temporary storage in the buffer tank 14, is supplied therefrom to the nozzle unit 11.

The aforementioned ink tank, which is detachably mounted in a printer frame (not shown) of the inkjet printer 100, stores therein ink to be supplied to the nozzle unit 11. The capacity of the ink tank is larger than that of the buffer tank 14. Although not illustrated, the inkjet printer 100 is provided with a plurality of ink tanks on a per-ink-color basis for permitting multi-color printing, namely, ink tanks for black-, cyan-, magenta-, and yellow-colors.

As illustrated in FIG. 2, the inkjet printer 100 is provided with rear and front guide members 2A and 2B extending in parallel to each other at rear and front sides of the aforementioned printer frame, respectively. Each of the rear and front guide members 2A and 2B extends in a lateral direction of the aforementioned printer frame (hereinafter, referred to as "frame lateral direction"). The head holder 12 is slidably supported at the rear and front guide members 2A and 2B.

As illustrated in FIG. 5, the rear guide member 2A is generally L-shaped in section when viewed in a direction perpendicular to the sliding direction of the head holder 12, while the front guide member 2B has a flat surface extending in the sliding direction of the head holder 12.

As illustrated in FIG. 1, an endless timing belt 4 which is wounded around a driving pulley 3A and a driven pulley 3B is partly joined to the head holder 12. Rotation of the driving pulley 3A driven by a driving motor 5 allows the head holder 12 to reciprocally move along the guide members 2A and 2B in the aforementioned frame lateral direction, via the timing belt 4. A top of the head holder 12 is covered with a cover 24.

Although not illustrated, in the inkjet printer 100, a well known sheet feeding mechanism feeds a sheet of paper "P" (print medium) under the nozzle unit 11 in a direction (indicated by arrow A in FIG. 1) perpendicular to the moving direction of the head holder 12 (the frame lateral direction), with the sheet of paper "P" being printable.

Although not illustrated, the inkjet printer 100 further includes an ink receiver and a maintenance unit. The ink receiver is for flushing, namely, for periodically ejecting ink droplets during a printing operation, to thereby prevent the nozzles from being clogged. The maintenance unit is for cleaning the surface of a nozzle plate having the nozzles, for recovery in which contaminated or unnecessary ink is selectively suctioned on a per-ink-color basis, and for removing air bubbles (air) from the buffer tank 14.

In operation, the nozzle unit 11 ejects ink droplets onto a sheet of paper "P" being fed, corresponding to the reciprocal movement of the head holder 12. As illustrated in FIG. 3, the nozzle unit 11 is so configured as to include a cavity unit 17, a piezoelectric device 19 (piezoelectric actuator), and a flexible flat cable 20.

As illustrated in FIG. 2, a plurality of nozzles 16*a*, 16*b*, 16*c*, and 16*d* are formed in the cavity unit 17. The piezoelectric device 19 is driven for ejecting ink droplets from the respective nozzles 16*a*, 16*b*, 16*c*, and 16*d* formed in the cavity unit 17. The flexible flat cable 20 is used as a signal path through which signals (voltages) for driving the piezoelectric device 19 are supplied to the piezoelectric device 19.

As illustrated in FIG. 3, at one of both ends of the nozzle unit 11, a plurality of ink supply ports 18*a*, 18*b*, 18*c*, and 18*d* of the cavity unit 17 are formed. The ink supply ports 18*a*, 18*b*, 18*c*, and 18*d*, which form a line in arrangement and which have respective openings on a top face of the nozzle unit 11, are provided on a per-ink-color basis (four colors in total, in the present embodiment). The area of the opening of the ink supply port 18*a* for black-colored ink (BK) is larger than those of the ink supply ports 18*b*, 18*c*, and 18*d* for cyan-(C), yellow-(Y), and magenta-colored ink (M).

Ink is supplied from the ink supply ports 18*a*, 18*b*, 18*c*, and 18*d* toward the plurality of nozzles 16*a*, 16*b*, 16*c*, and 16*d* illustrated in FIG. 2, via ink supply channels (not shown) formed within the cavity unit 17 on a per-ink-color basis. In the nozzle unit 11, the piezoelectric device 19 illustrated in FIG. 3 is activated to eject ink droplets from the plurality of nozzles 16*a*, 16*b*, 16*c*, and 16*d*.

As illustrated in FIG. 3, in the nozzle unit 11, the outer dimension or profile of the piezoelectric device 19 is smaller than that of the cavity unit 17 when viewed in top view. As a result, once the piezoelectric device 19 is superposed on a back face of the cavity unit 17 (the top face of the cavity unit 17, in FIG. 3), the back face of the cavity unit 17 is exposed partially at a perimeter portion of the cavity unit 17 which surrounds the piezoelectric device 19 and at which the ink supply ports 18*a*, 18*b*, 18*c*, and 18*d* are formed.

As illustrated in FIG. 3, to a top face of the piezoelectric device 19, a base portion of the flexible flat cable 20 for applying a voltage to the piezoelectric device 19 is fixed. The flexible flat cable 20 includes a driver IC 21.

For cooling down the driver IC 21 which generates heat, a heat sink 23 made of aluminum alloy is disposed in contact with the driver IC 21, as illustrated in FIG. 4. Due to this, the self-cooling of the driver IC 21 is achieved via the heat sink 23.

As illustrated in FIG. 5, the flexible flat cable 20 is electrically coupled to a printed circuit board 22 which is disposed at an upper portion of the buffer tank 14.

As illustrated in FIG. 5, the printed circuit board 22 is supported at the head holder 12 (support) in opposing relationship to the nozzle unit 11. The printed circuit board 22 supplies to the piezoelectric device 19 drive signals for permitting the nozzle unit 11 to eject ink droplets. The printed circuit board 22 is electrically coupled to another printed circuit board (not shown) disposed on the side of a main body of the inkjet printer 100, via another flexible flat cable (not shown).

As illustrated in FIGS. 3 and 4, the buffer tank 14 includes a main body case 25 having an inner space therein. As illustrated in FIG. 4, the inner space of the main body case 25 is partitioned by partition walls into a plurality of air bubble reservoirs 31*a*, 31*b*, 31*c*, and 31*d* all of which are independent of one another on a per-ink-color basis.

The air bubble reservoirs 31*a*, 31*b*, 31*c*, and 31*d* include the air bubble reservoir 31*a* for black-colored ink (BK), the air bubble reservoir 31*b* for cyan-colored ink (C), the air bubble reservoir 31*c* for yellow-colored ink (Y), and the air bubble reservoir 31*d* for magenta-colored ink (M).

As illustrated in FIG. 3, the main body case 25 is comprised of a box-like lower case 26 whose top face is open, and an upper case 27 which is fixed to the lower case 26 so as to cover the top face of the lower case 26. The lower and upper cases 26, 27 are formed separately by an injection-molding process with synthetic resin material, and they are coupled to each other by an ultrasonic welding or adhesion, etc., in a fluid-tight manner. The coupling of the lower and upper cases 26, 27 results in the formation of the plurality of air bubble reservoirs 31*a*, 31*b*, 31*c*, and 31*d* within the main body case 25.

The air bubble reservoirs 31*a*, 31*b*, 31*c*, and 31*d* each function not only as a chamber for storing air bubbles contained in ink, but also as a chamber for temporarily storing ink on a per-ink-color basis. As illustrated in FIG. 4, the air bubble reservoirs 31*a*, 31*b*, 31*c*, and 31*d* are communicated at their one ends with ink outlet ports 32*a*, 32*b*, 32*c*, and 32*d* provided for respective ink colors, respectively.

As illustrated in FIG. 3, the nozzle unit 11 is attached to a bottom face of a bottom plate 12*a*, which is formed as a wall on a bottom side of the head holder 12 and which is substantially in parallel to the back face of the nozzle unit 11. As a result, in an upper area of the bottom plate 12*a* of the head holder 12, the buffer tank 14 for temporary storage of ink, and an exhaust valve device 15 (see FIG. 4) for exhausting air bubbles stored in the air bubble reservoirs 31*a*, 31*b*, 31*c*, and 31*d* of the buffer tank 14 are mounted.

As illustrated in FIG. 4, ink is supplied from the aforementioned ink tank to the nozzle unit 11 via the ink supply tubes 13*a*, 13*b*, 13*c*, and 13*d*. The ink is temporarily stored in the air bubble reservoirs 31*a*, 31*b*, 31*c*, and 31*d* each of which is located in a corresponding one of ink flow channels. Due to this, air bubbles contained in ink are separated from the ink and floated for collection in upper spaces of the air bubble reservoirs 31*a*, 31*b*, 31*c*, and 31*d*. The collected air bubbles are exhausted from the air bubble reservoirs 31*a*, 31*b*, 31*c*, and 31*d* by activating a suction pump (not shown) with the exhaust valve device 15 being open.

In FIG. 2 illustrating the nozzle unit 11 in bottom view, the plurality of nozzles 16*a*, 16*b*, 16*c*, and 16*d* are arranged in arrays on a bottom face of the nozzle unit 11 so as to be exposed in a direction opposing to the print face of a sheet of paper "P" (not shown).

The arrays of the nozzles 16*a*, 16*b*, 16*c*, and 16*d* extend in parallel to a direction (sub-scanning direction) perpendicular to the sliding direction (main scanning direction) of the head holder 12. In the nozzle unit 11, there are arranged in a row from left to right in FIG. 2, two arrays of the nozzles 16*a* for black-colored ink (BK), one array of the nozzles 16*b* for cyan-colored ink (C), one array of the nozzles 16*c* for yellow-colored ink (Y), and one array of the nozzles 16*d* for magenta-colored ink (M).

As illustrated in FIG. 5, the ink outlet ports 32*a*, 32*b*, 32*c*, and 32*d*, which form a line in arrangement in a lower plate of the lower case 26, penetrate through the bottom plate 12*a* and extend downwardly out from the bottom face of the bottom plate 12*a*. The ink outlet ports 32*a*, 32*b*, 32*c*, and 32*d*, which are open downwardly at their bottom ends, are disposed in opposing relationship to the ink supply ports 18*a*, 18*b*, 18*c*, and 18*d* formed on the top face of the cavity unit 17 (nozzle unit 11), respectively.

As illustrated in FIG. 5, the nozzle unit 11 is fixed at its back face (it top face in FIG. 5) to a lower portion of the head holder 12 with a hollow reinforcement frame 33 being interposed therebetween. As illustrated in FIG. 5, further, an elastic seal member 34 such as rubber packing is interposed between the reinforcement frame 33 and the lower plate of the lower case 26. As a result, the ink outlet ports 32*a*, 32*b*, 32*c*, and 32*d* are brought into communication with the ink supply ports 18*a*, 18*b*, 18*c*, and 18*d* of the cavity unit 17, via four ink passage ports 33*b*, 33*c*, 33*d*, and 33*e* each penetrating through both the elastic seal member 34 and the reinforcement frame 33, respectively.

As illustrated in FIG. 3, through the reinforcement frame 33, the ink passage ports 33*b*, 33*c*, 33*d*, and 33*e* penetrate so as to form a line corresponding to the ink supply ports 18*a*, 18*b*, 18*c*, and 18*d* of the cavity unit 17, respectively. The ink passage ports 33*b*, 33*c*, 33*d*, and 33*e* are disposed at one of both longitudinal ends of the reinforcement frame 33.

As illustrated in FIG. 3, the reinforcement frame 33 is in the form of a flat plate extending along the back face of the nozzle unit 11 and includes therein a central opening 33*a*. The central opening 33*a* is sized to be slightly larger than the outer dimension of the piezoelectric device 19 and to be smaller than the outer dimension of the cavity unit 17, when viewed in top view. The reinforcement frame 33 is adhesively fixed to the back face of the cavity unit 17 (its top face in FIG. 3) such that the piezoelectric device 19 and the flexible flat cable 20 are located within (fitted into) the central opening 33*a*.

The reinforcement frame 33 made of metal (SUS 430, for example) is so formed as to be greater in thickness and rigidity than the cavity unit 17. Because the reinforcement frame 33 is made of electrically conductive metal, electrical continuity is achieved between the reinforcement frame 33 and the cavity unit 17 which is adhesively fixed to the reinforcement frame 33.

As illustrated in FIG. 3, a protective cover 51 is mounted on the reinforcement frame 33 on the same side as the cavity unit 17. The protective cover 51 is provided for protecting the nozzle unit 11, by filling the gap between the surface of the nozzle unit 11 and the surface of the reinforcement frame 33, which is formed in an assembly of the nozzle unit 11 and the reinforcement frame 33.

To this end, the protective cover 51 is so formed as to include, when viewed in top view, a frame portion surrounding the nozzle unit 11, and a hole portion into which the nozzle unit 11 is fitted for complementing the hole portion. The protective cover 51 is substantially the same as the cavity unit 17 in thickness. Due to this, the front surfaces of the nozzle unit 11 and the protective cover 51 become almost flush with each other, once the protective cover 51 is mounted on the reinforcement frame 33.

As illustrated in FIGS. 3-5, in the buffer tank 14, a flange-shaped extension 27*a* extends out from one of both side faces of the upper case 27 (main body case 25) on the opposite side to the side where the ink outlet ports 32*a*, 32*b*, 32*c*, and 32*d* are disposed.

As illustrated in FIG. 4 in top plan view, there are formed in the extension 27*a*, ink flow channels for respective colors, namely, an ink inlet pathway 35*a* for black-colored ink (BK), an ink inlet pathway 35*b* for cyan-colored ink (C), an ink inlet pathway 35*c* for yellow-colored ink (Y), and an ink inlet pathway 35*d* for magenta-colored ink (M), all of which are independent of one another on a per-ink-color basis. The ink inlet pathways 35*a*, 35*b*, 35*c*, and 35*d* communicate at their downstream ends with the plurality of air bubble reservoirs 31*a*, 31*b*, 31*c*, and 31*d*, respectively.

As illustrated in FIG. 5 in side view, an extension 12*b* of the head holder 12 is formed below the extension 27*a* in parallel to the extension 27*a*.

As illustrated in FIG. 4, on a free end of the extension 27*a*, a tube joint 36 is disposed which includes tube connecting portions 36*a*, 36*b*, 36*c*, and 36*d* on a per-ink-color basis. The tube joint 36 is mounted on both extensions 27*a*, 12*b* elastically via a spring 37.

The tube joint 36 includes a plurality of ink flow channels (not shown) formed within the tube joint 36 and the plurality of tube connecting portions 36*a*, 36*b*, 36*c*, and 36*d*.

Those ink flow channels communicate at their downstream ends with the plurality of ink inlet pathways 35*a*, 35*b*, 35*c*, and 35*d* at their upstream ends, respectively. The ink supply tubes 13*a*, 13*b*, 13*c*, and 13*d* which communicate at their one ends with the aforementioned ink tank are detachably connected at their other ends to the tube connecting portions 36*a*, 36*b*, 36*c*, and 36*d*, respectively. The tube joint 36 further includes an integrated holder 36*e* for holding the flexible flat cable 20.

As illustrated in FIG. 5, a plurality of exhaust passages are disposed in a top face area of the upper case 27 independently one another on a per-ink-color basis, although only exhaust passages 41*b*, 41*c*, and 41*d* for the respective air bubble reservoirs 31*b*, 31*c*, 31*d* are illustrated in FIG. 5. For forming the exhaust passages 41*b*, 41*c*, and 41*d*, a plurality of recesses which are open at their top faces are formed in a top plate of the upper case 27. These recesses are covered at their open top faces with a flexible film 42, to thereby define the plurality of exhaust passages 41*a*, 41*b*, 41*c*, and 41*d*.

The exhaust passages 41*a*, 41*b*, 41*c*, and 41*d* communicate at their one ends with upper spaces within the plurality of air bubble reservoirs 31*a*, 31*b*, 31*c*, and 31*d*, respectively, while the exhaust passages 41*a*, 41*b*, 41*c*, and 41*d* communicate at their other ends with top ends of a plurality of exhaust holes, respectively. The exhaust holes are formed on a per-ink-color basis so as to extend across the main body case 25 (upper case 27) and subsequently penetrate through the lower case 26.

Figure 6:
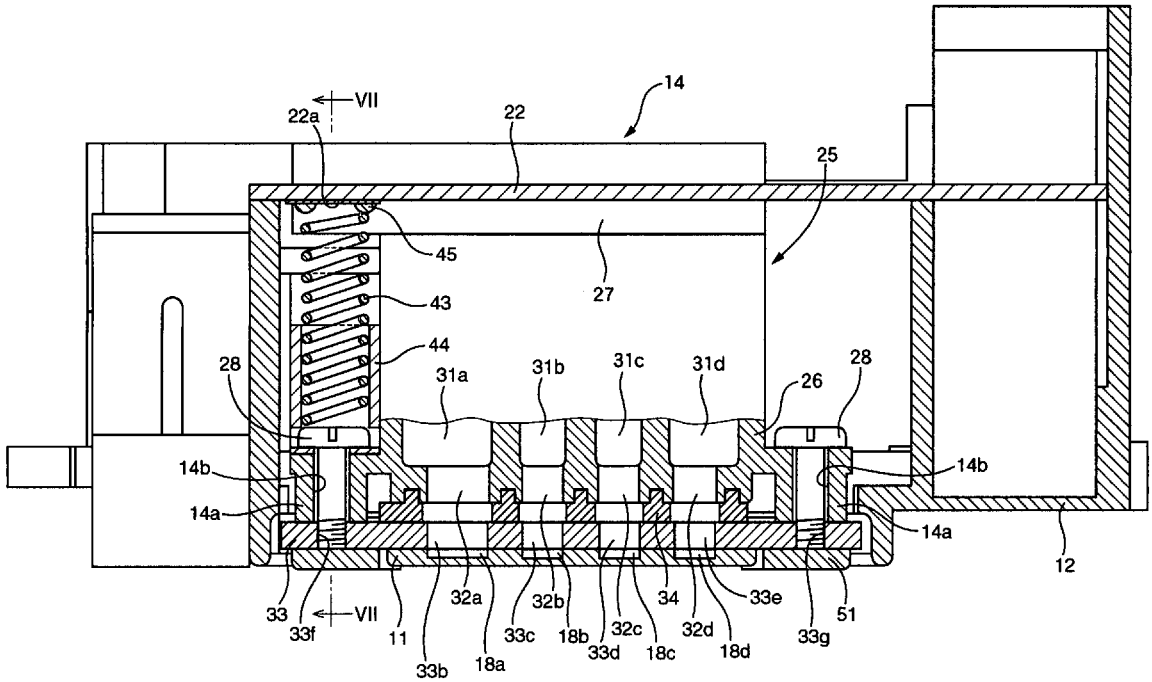
FIG. 6 is a cross sectional view take on line VI-VI in FIG. 4.

As illustrated in FIGS. 3 and 6, screwed holes 33*f* and 33*g* are provided in corners of the reinforcement frame 33. In alignment with the screwed holes 33*f* and 33*g*, a plurality of attachment portions 14*a* are formed on an outer circumferential lateral face of the buffer tank 14, so as to protrude outwardly therefrom. Attachment holes 14*b* are formed in and through the respective attachment portions 14*a*.

As illustrated in FIG. 6, two screws 28 (each is an example of the electrically conductive fixture) penetrate through the respective attachment holes 14*b*, and are screwed into the respective screwed holes 33*f* and 33*g*, resulting in the fixing of the buffer tank 14 onto the top face of the reinforcement frame 33. The reinforcement frame 33 itself, because has been adhesively fixed to the bottom face of the bottom plate 12*a* of the head holder 12 (an example of the support), as discussed above, allows the installation of the nozzle unit 11 and the buffer tank 14 to the head holder 12.

Figure 7:
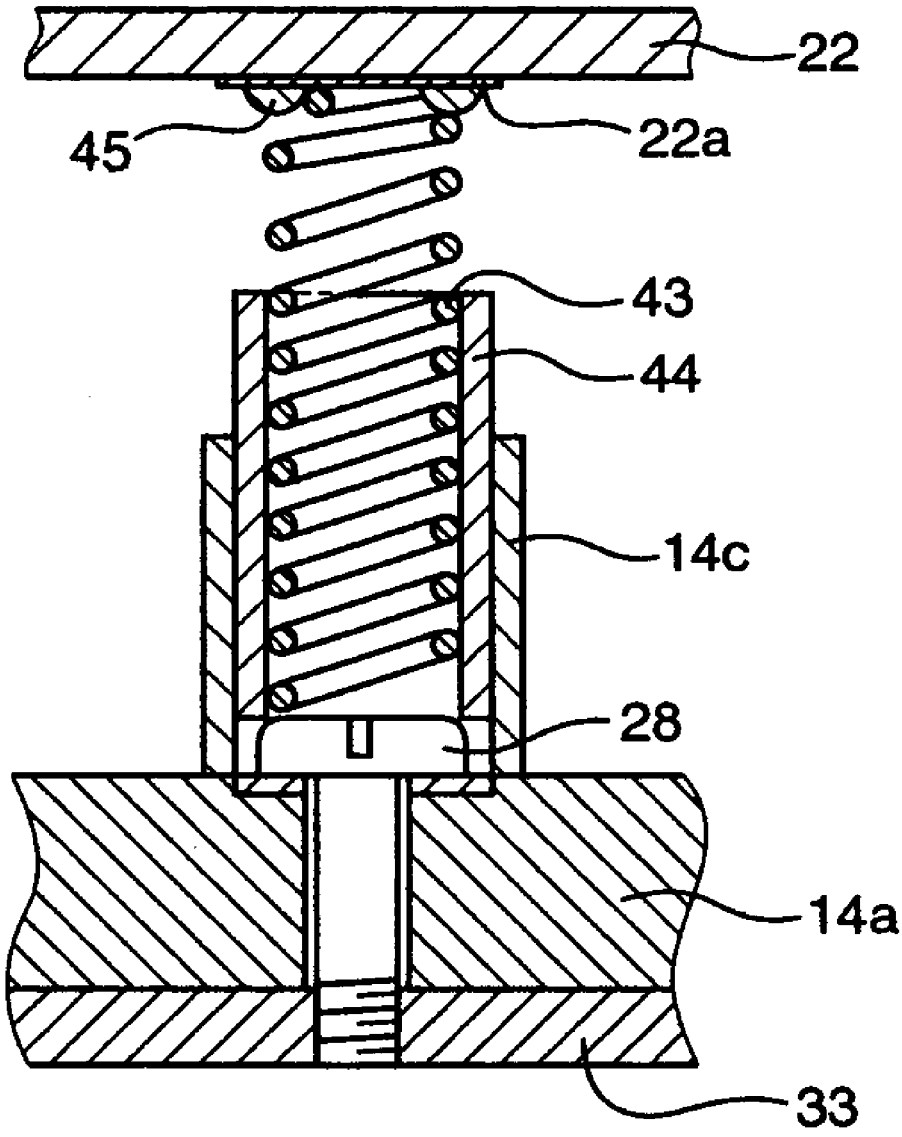
FIG. 7 is a cross sectional view taken on line VII-VII in FIG. 6.

As illustrated in FIGS. 6 and 7, one of the two screws 28, 28 functions as an earth contact of the nozzle unit 11, wherein the one screw 28 is disposed in opposing relationship to a ground contact 22*a* of the printed circuit board 22. The electric potential of the ground contact 22*a* of the printed circuit board 22 is electrically held at a reference potential.

As illustrated in FIG. 6, an electrically conductive coil spring 43 is provided between the one screw 28 and the ground contact 22*a* of the printed circuit board 22. The coil spring 43 is located in one of the corners of the head holder 12, and is retained so as to extend along the height of a lateral wall of the head holder 12 toward the ground contact 22*a* which is disposed right above the one screw 28.

As illustrated in FIG. 6, an electrically insulative cylindrical member 44, into which a bottom end (one of both ends) of the coil spring 43 is inserted, is disposed above the aforementioned one screw 28. In the ground contact 22*a* of the printed circuit board 22, a recessed portion 45 (an example of the movement limiter) is formed which limits a movement (for example, a lateral displacement) of a top end (the other end) of the coil spring 43. The recessed portion 45 includes a movement limiting surface extending in an oblique or a perpendicular direction to a radial direction of the coil spring 43.

As illustrated in FIG. 7, the recessed portion 45 is formed, in the shape of allowing the engagement (internal fitting) with the coil spring 43 at the top end, with electrically conductive material (solder, for example).

Figure 8A:
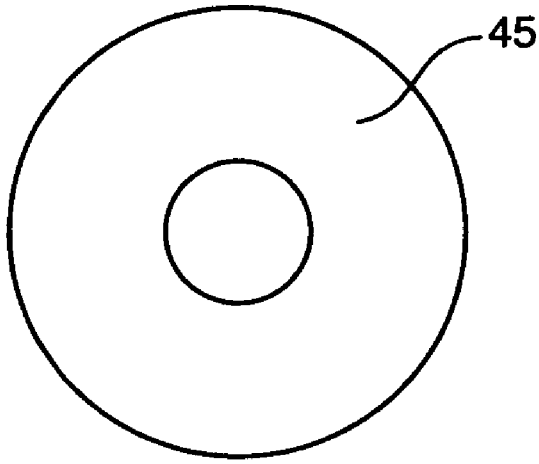
FIG. 8A is a plan view illustrating a recessed portion shown in FIG. 7.
Figure 8B:
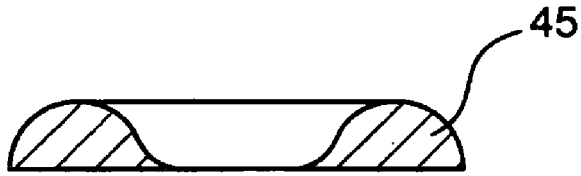
FIG. 8B is a longitudinal sectional view illustrating the recessed portion shown in FIG. 7.

FIGS. 8A and 8*b* illustrate the recessed portion 45 in top plan view and sectional view, respectively. The recessed portion 45 is formed within an annular projection, and the diameter of an inner circumferential wall face of the recessed portion 45, namely, an internal diameter of the recessed portion 45 is associated with an external diameter of the top end of the coil spring 43. For example, the internal diameter of the recessed portion 45 is set to be equal to or be slightly smaller than the external diameter of the top end of the coil spring 43.

The recessed portion 45 can be formed by applying electrically conductive material onto the ground contact 22*a*, for example, continuously (without interruption) along a circle.

Once the recessed portion 45 engages with the coil spring 43 at its top end, a movement (for example, a lateral displacement) of the top end of the coil spring 43 is suppressed. On the side where the aforementioned one screw 28 is disposed, the cylindrical member 44 is partly supported by a rib 14*c* formed in the buffer tank 14 to prevent the cylindrical member 44 from tilting.

In the present embodiment, as illustrated in FIG. 7, the coil spring 43 is inserted at its bottom end into the cylindrical member 44, while the coil spring 43 is in contact at its top end with the ground contact 22*a*, with the movement of the top end of the coil spring 43 being suppressed by the recessed portion 45. As a result, the aforementioned one screw 28 (an example of the earth contact of the nozzle unit 11) is electrically coupled to the ground contact 22*a* via the coil spring 43.

Once the coil spring 43 has been inserted into the cylindrical member 44, the coil spring 43 is initially in a free state (unloaded state), and a tip end of the coil spring 43 is upwardly above a position at which the tip end is expected to be located upon later attachment with the printed circuit board 22. Thereafter, the printed circuit board 22 is moved from above the head holder 12 to the head holder 12 until the printed circuit board 22 is fixed to a top portion of the side wall of the head holder 12. The coil spring 43 is more compressed, as the printed circuit board 22 is moved toward the head holder 12.

The nozzle unit 11 and the printed circuit board 22, during the print operation of the inkjet printer 100, are integrally moved back and forth in the aforementioned frame lateral direction (main scanning direction), without relative movement in a direction in which the nozzle unit 11 and the printed circuit board 22 are opposed to each other.

Because the ground contact 22*a* of the printed circuit board 22 is located right above the aforementioned one screw 28, the coil spring 43 in compression is in contact at its one end with the one screw 28, and at its other end with the ground contact 22*a*. Because of elastic compressive force of the coil spring 43, one end of the coil spring 43 is brought into electrical contact with the one screw 28, and the other end of the coil spring 43 is brought into electrical contact with the ground contact 22*a*.

As is apparent from the above, in the present embodiment, the electrical continuity between the nozzle unit 11 and the printed circuit board 22 is easily achieved merely by inserting the coil spring 43 into the cylindrical member 44, and by fixing the printed circuit board 22 to the head holder 12 so as to cover an upside of the head holder 12. Neither the nozzle unit 11 nor the printed circuit board 22 is mechanically fixedly connected with the coil spring 43.

Accordingly, the electrical continuity between the nozzle unit 11 and the printed circuit board 22 can be achieved without requiring an additional process of mechanically fixedly connecting the nozzle unit 11 to the coil spring 43, or of mechanically fixedly connecting the printed circuit board 22 to the coil spring 43.

In the present embodiment, the coil spring 43 provides the electrical continuity between the nozzle unit 11 and the printed circuit board 22, and as a result, the electric potential of the one screw 28 (functioning as the earth contact of the nozzle unit 11) becomes equal to that of the ground contact 22*a* of the printed circuit board 22, namely, the reference potential. Accordingly, the electric potentials of at least the nozzle unit 11 (cavity unit 17) and the reinforcement frame 33 on which the nozzle unit 11 is mounted each become equal to the reference potential.

Therefore, in the present embodiment, ink accommodated within the cavity unit 17 is prevented from being subject to unwanted charge, resulting in the prevention of chemical attack on the piezoelectric device 19 causing expedited deterioration in quality of the piezoelectric device 19.

It is added that, where the head holder 12 is made of electrically conductive material, the electric potential of the entirety of the inkjet head 1 becomes substantially equal to the reference potential. As a result, there are suppressed the unwanted variations in the electric potential of the inkjet head 1 and adverse effect of the noise due to the outside magnetic field.

As illustrated in FIG. 3, the nozzle unit 11 includes the cavity unit 17 in the form of a laminate of a plurality of plates, and the piezoelectric element 19, to thereby eject ink droplets.

As illustrated in FIG. 2 in bottom view, the cavity unit 17 includes a nozzle plate 61 containing arrays of the plurality of nozzles 16*a*-16*d* at its front face (at its bottom face, in FIG. 3), and a plurality of intermediate plates (not shown) which are successively superposed onto the nozzle plate 61 and which define the ink flow channels. The cavity unit 17 is in the form of a laminate of a plurality of plates including the nozzle plate 61 and the plurality of intermediate plates which are adhesively bounded to one another in superposed relationship.

The nozzle plate 61 is made of a synthetic resin (polyimide resin, for example), while other plates are each made of nickel alloy steel with a thickness of between approximately 50 μm and approximately 150 μm. In and through the nozzle plate 61, the plurality of nozzles 16*a*, 16*b*, 16*c*, and 16*d* each having a micro-size diameter (approximately 25 μm, in the present embodiment) are formed at micro-size spacings therebetween.

As discussed above, the nozzles 16*a*, 16*b*, 16*c*, and 16*d* are arranged in five arrays in a staggered fashion, extending along a longitudinal direction of the nozzle plate 61. On the other hand, in each of the intermediate plates, recesses or through holes have been constructed for defining pressure chambers, etc., by etching machining, electrical discharging machining, plasma machining, laser beam machining, etc.

As illustrated in FIG. 3, the piezoelectric device 19 is adhesively fixed onto the top side of the cavity unit 17 via an adhesive seat (not shown) so as to have a predetermined positional relationship with the cavity unit 17. The adhesive seat is made of adhesive in the form of ink-impermeable synthetic resin material. The flexible flat cable 20 is superposed on the top surface of the piezoelectric device 19 in pressing contact therewith, resulting in the electrical connection of various patterned circuit or wirings (not shown) in the flexible flat cable 20 with the piezoelectric device 19.

As illustrated in FIG. 3, at one of both ends of the cavity unit 17 including the pressure chambers (not shown), the four ink supply ports 18*a*, 18*b*, 18*c*, and 18*d* are formed through the cavity unit 17. As described above, the ink outlet ports 32*a*, 32*b*, 32*c*, and 32*d* in the buffer tank 14 are communicated with the four ink supply ports 18*a*, 18*b*, 18*c*, and 18*d*, respectively.

The distribution of ink into the plurality of pressure chambers is performed in the ink flow channels extending from the ink supply ports 18*a*, 18*b*, 18*c*, and 18*d* to the plurality of nozzles 16*a*, 16*b*, 16*c*, and 16*d*. Ink is supplied by the activation of the piezoelectric device 19 from each of the pressure chambers to a corresponding one of the nozzles 16*a*, 16*b*, 16*c*, and 16*d*.

Next, with reference to FIG. 9, an ink jet head 1 constructed according to a second embodiment of the present invention will be described.

In view of the fact that the present embodiment is substantially common in basic construction to the first embodiment except elements relating to a recessed portion, the common elements of the present embodiment to those of the first embodiment will be referenced the same reference numerals as those in the description and illustration of the first embodiment, without a redundant description and illustration, while the different elements of the present embodiment from those of the first embodiment will be described in more detail.

Figure 9A:
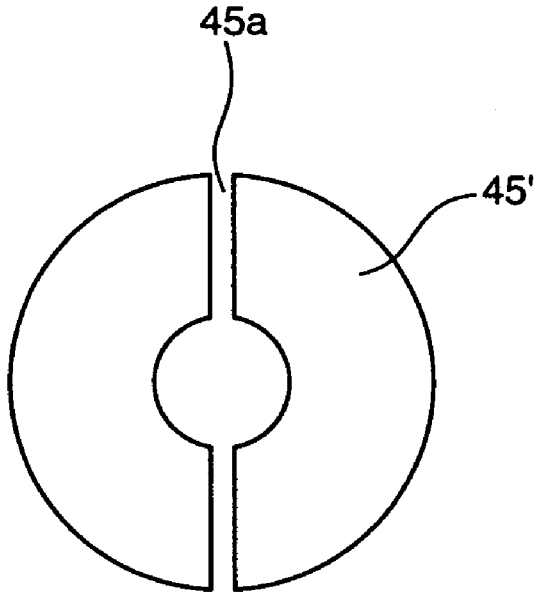
FIG. 9A is a plan view illustrating a recessed portion in an inkjet printer constructed according to a second embodiment of the present invention.
Figure 9B:
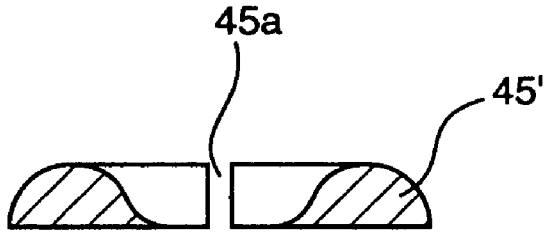
FIG. 9B is a longitudinal sectional view illustrating the recessed portion.

In the present embodiment, as with the first embodiment, the coil spring 43 is inserted at its bottom end into the cylindrical member 44, while the coil spring 43 is in contact at its top end with the ground contact 22*a* of the printed circuit board 22, with the movement of the top end of the coil spring 43 being suppressed by a recessed portion 45', as illustrated in FIG. 9A. In FIGS. 9A and 9B, the recessed portion 45' is illustrated in top plan view and sectional view, respectively.

In the first embodiment, the recessed portion 45 is formed by applying electrically conductive material onto the ground contact 22*a* continuously (without interruption) along a circle. As a result, the recessed portion 45 is formed as a single or continuous body.

In contrast, in the present embodiment, the recessed portion 45' is formed by applying electrically conductive material onto the ground contact 22*a* non-continuously (with interruption) along a circle. As a result, the recessed portion 45' is formed as multiple bodies which are physically independent of each other or one another (two pieces, in the example shown in FIGS. 9A and 9B). This arrangement, like that of the first embodiment, permits the electrical continuity between the top end of the coil spring 43 and the ground contact 22*a* of the printed circuit board 22.

Figure 10:
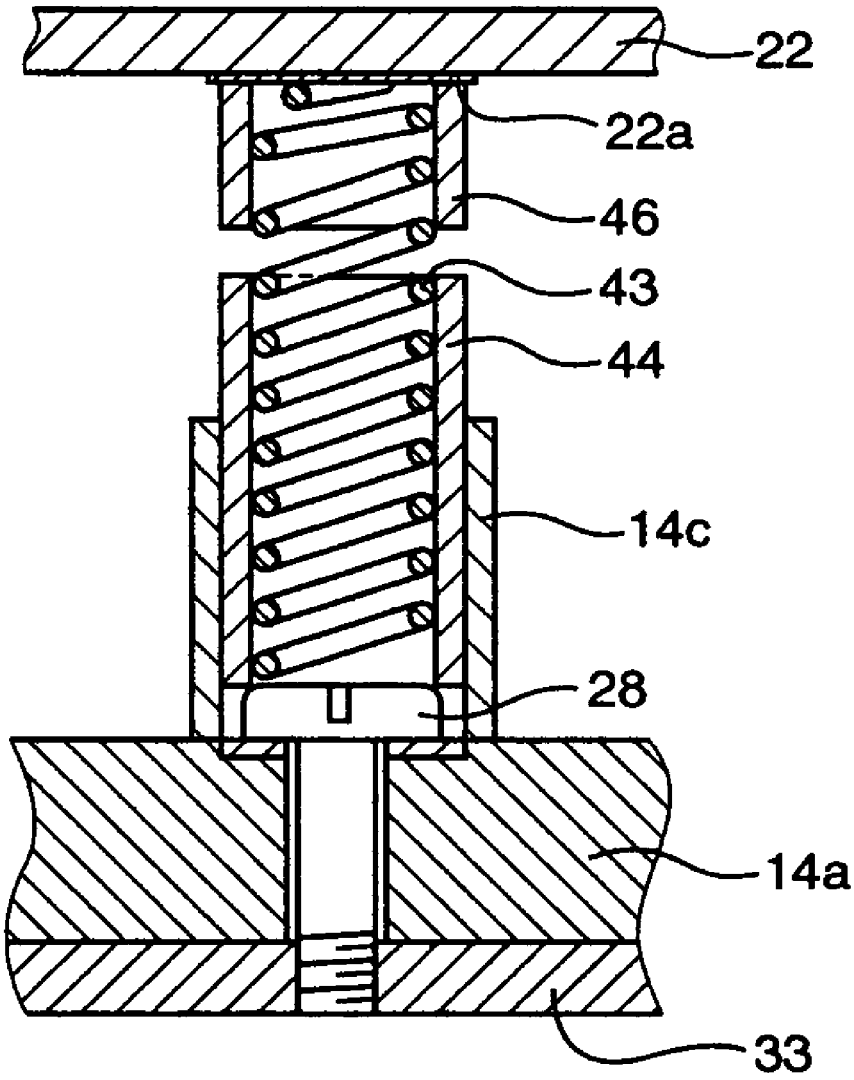
FIG. 10 is a longitudinal sectional view for explanation as to how a coil spring provides electrical continuity between two members in an inkjet head according to a third embodiment of the present invention.

Next, with reference to FIG. 10, an ink jet head 1 constructed according to a third embodiment of the present invention will be described.

In view of the fact that the present embodiment is substantially common in basic construction to the first embodiment except elements relating to the scheme of supporting the coil spring 43, the common elements of the present embodiment to those of the first embodiment will be referenced the same reference numerals as those in the description and illustration of the first embodiment, without a redundant description and illustration, while the different elements of the present embodiment from those of the first embodiment will be described in more detail.

In the first embodiment, the top end of the coil spring 43 is supported by the recessed portion 45 which is fixedly formed in the ground contact 22*a* of the printed circuit board 22. In contrast, in the present embodiment, the top end of the coil spring 43 is supported by an electrically insulative cylindrical member 46, as illustrated in FIG. 10. The top end of the coil spring 43 is inserted into the cylindrical member 46.

The cylindrical member 46 may be directly supported by the ground contact 22*a* of the printed circuit board 22 or by a separate member. In any case, the cylindrical member 46 is required to be held in position in contact with the ground contact 22*a* of the printed circuit board 22.

Therefore, in the present embodiment, the top end of the coil spring 43 is correctly located by the cylindrical member 46 instead of the recessed portion 45, with the unwanted lateral displacement of the top end of the coil spring 43 being properly suppressed.

In the present embodiment, the top end of the coil spring 43 is in direct contact with the ground contact 22*a* of the printed circuit board 22, thereby achieving electrical continuity therebetween.

Next, with reference to FIG. 11, an inkjet head 1 constructed according to a fourth embodiment of the present invention will be described.

In view of the fact that the present embodiment is substantially common in basic construction to the first embodiment except elements relating to the scheme of supporting the coil spring 43, the common elements of the present embodiment to those of the first embodiment will be referenced the same reference numerals as those in the description and illustration of the first embodiment, without a redundant description and illustration, while the different elements of the present embodiment from those of the first embodiment will be described in more detail.

In the first embodiment, the top end of the coil spring 43 is supported by the recessed portion 45 which is fixedly formed on the ground contact 22*a* of the printed circuit board 22. In contrast, in the present embodiment, not only the bottom end but also the top end of the coil spring 43 is supported by an electrically insulative cylindrical member 44' which is common to the bottom and top ends of the coil spring 43, as illustrated in FIG. 11.

The cylindrical member 44' is equivalently obtained by prolonging the cylindrical member 44 in a direction from its bottom end toward its top end, namely, a direction from the one screw 28 toward the ground contact 22*a* of the printed circuit board 22. Into the cylindrical member 44', the coil spring 43 is inserted.

Figure 11:
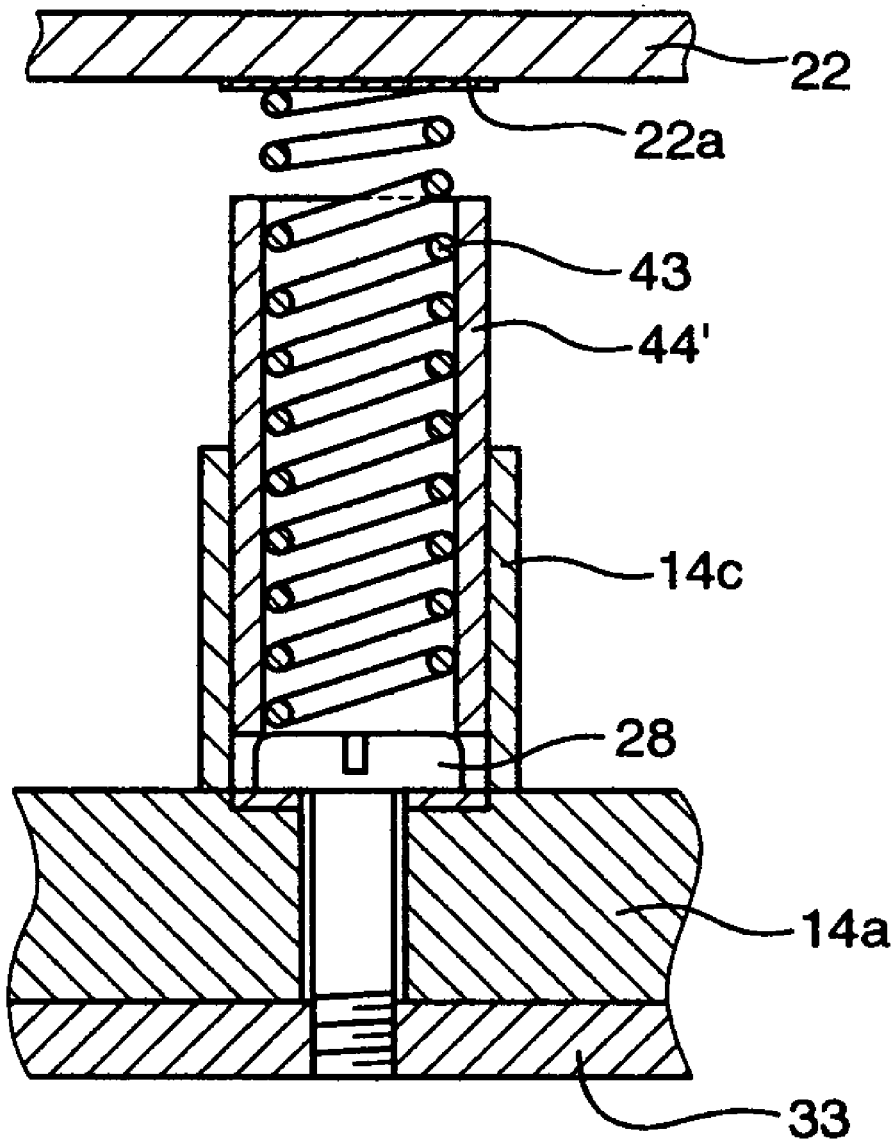
FIG. 11 is a longitudinal sectional view for explanation as to how a coil spring provides electrical continuity between two members in an inkjet head according to a fourth embodiment of the present invention.

More specifically, as illustrated in FIG. 11, the cylindrical member 44' is extended so as to bridge from the one screw 28 (functioning as the earth contact of the nozzle unit 11) to a position in the vicinity of the ground contact 22*a* of the printed circuit board 22. For this reason, adding a local movement-limiter to the top end of the coil spring 43 can be omitted.

The one screw 28 is an electrically conductive fixture for fixing the nozzle unit 11 to the head holder 12 (an example of the support).

In the present embodiment, the bottom end of the coil spring 43 is inserted into the cylindrical member 44' into contact with the one screw 28, while the top end of the coil spring 43 is brought into contact with the ground contact 22*a*. As a result, the one screw 28, as the earth contact of the nozzle unit 11, is brought into electrical engagement with the ground contact 22*a* of the printed circuit board 22, via the coil spring 43.

In the present embodiment, there may be formed in the ground contact 22*a* a projecting portion which is inserted or fitted into the central hole of the top end of the coil spring 43, whereby an unwanted lateral movement of the top end of the coil sprint 43 is more securely prevented. This arrangement provides improved reliability of electrical connection between the projecting portion and the top end of the coil spring 43.

In the present embodiment, instead of the projecting portion, there may be formed in the ground contact 22*a* of the printed circuit board 22, with electrically conductive material, a recessed portion with which the top end of the coil spring 43 engages, similarly with the first and second embodiments of the present invention. Like the above projecting portion, this arrangement provides enhanced reliability of electrical connection between the recessed portion and the top end of the coil spring 43.

Figure 12:
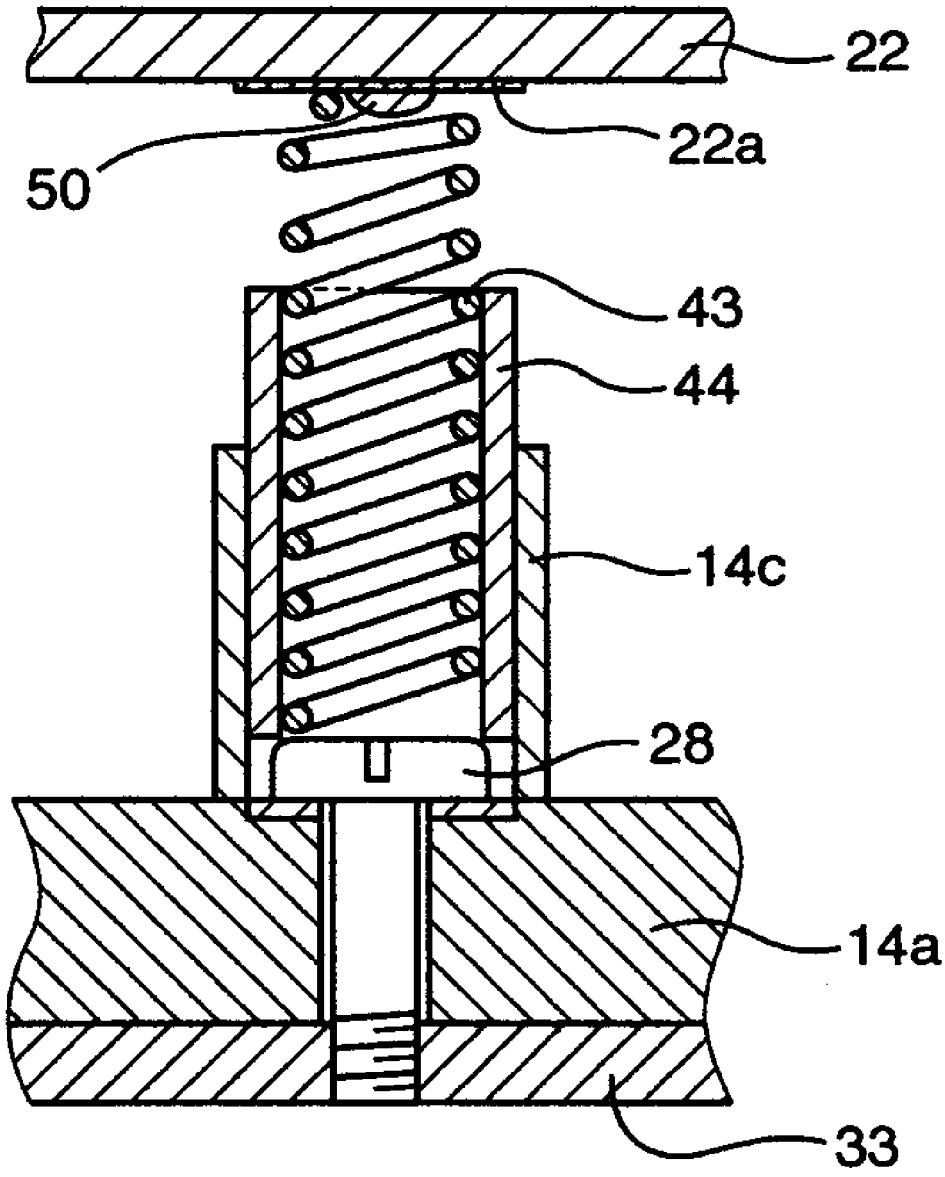
FIG. 12 is a longitudinal sectional view for explanation as to how a coil spring provides electrical continuity between two members in an inkjet head according to a fifth embodiment of the present invention.

Next, with reference to FIG. 12, an inkjet head 1 constructed according to a fifth embodiment of the present invention will be described.

In view of the fact that the present embodiment is common in basic construction to the first embodiment except elements relating to the scheme of supporting the coil spring 43, the common elements of the present embodiment to those of the first embodiment will be referenced the same reference numerals as those in the description and illustration of the first embodiment, without a redundant description and illustration, while the different elements of the present embodiment from those of the first embodiment will be described in more detail.

In the first embodiment, the top end of the coil spring 43 is supported by the recessed portion 45 which is fixedly formed in the ground contact 22*a* of the printed circuit board 22. In contrast, in the present embodiment, the top end of the coil spring 43 is supported by a projecting portion 50 which is fixedly formed in the ground contact 22*a* of the printed circuit board 22, as illustrated in FIG. 12.

The projecting portion 50 is formed in the shape allowing its fit into the central hole of the top end of the coil spring 43, with electrically conductive material (solder, for example). The projecting portion 50 is generally in the form of a cone, and its external dimension or profile is associated with the internal diameter or profile of the central hole of the top end of the coil spring 43. For example, the external diameter of the projecting portion 50 is set to be equal to or be slightly smaller than the internal diameter of the central hole of the top end of the coil spring 43.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An inkjet head for ejecting ink droplets in an inkjet manner, comprising:

a nozzle unit having a plurality of metal thin plates and a piezoelectric device, adapted to eject the ink droplets;

a printed circuit board supplying to the piezoelectric device a drive signal for causing the nozzle unit to eject the ink droplets;

a support supporting the nozzle unit and the printed circuit board in opposing relationship to each other;

an earth contact disposed on the nozzle unit;

a ground contact disposed on the printed circuit board, held at a reference potential;

an electrically conductive elastic member disposed between the earth contact and the ground contact, such that a first portion of the elastic member electrically contacts the earth contact, while a second portion of the elastic member electrically contacts the ground contact, to thereby provide electrical continuity between the earth contact of the nozzle unit and the around contact of the printed circuit board, both of which are electrically held at the reference potential; and a movement limiter limiting movement of the elastic member, to thereby prevent the elastic member from being disengaged from the earth and ground contacts.

2. The inkjet head according to claim 1, wherein the movement limiter mechanically engages with at least one of the first and second portions of the elastic member, to thereby suppress movement of the elastic member away from a predetermined normal position thereof.

3. The inkjet head according to claim 1, wherein the elastic member is detachably attached to the earth and ground contacts in electrical contact therewith, with the elastic member being interposed between the earth and ground contacts.

4. The inkjet head according to claim 1, wherein the elastic member is in electrical contact with the earth and ground contacts with the elastic member being compressed between and by the earth and ground contacts.

5. The inkjet head according to claim 1, wherein the earth contact comprises an electrically conductive fixture for fixing the nozzle unit to the support.

6. The inkjet head according to claim 1, wherein the elastic member comprises a coil spring, the coil spring having two opposite ends, at one of which the coil spring is pressed against the earth contact for electrical contact therewith, and at the other of which the coil spring is pressed against the ground contact for electrical contact therewith.

7. The inkjet head according to claim 6, wherein the movement limiter mechanically engages with at least one of the two opposite ends of the coil spring, to thereby suppress movement of the coil spring away from a predetermined normal position thereof.

8. The inkjet head according to claim 7, wherein the movement limiter comprises an earth-contact-side member disposed at or near the earth contact for limiting movement of the one end of the coil spring.

9. The inkjet head according to claim 8, wherein the earth-contact-side member comprises a first cylindrical member into which the one end of the coil spring is inserted.

10. The inkjet head according to claim 9, wherein the first cylindrical member is electrically insulative.

11. The inkjet head according to claim 9, wherein the earth contact is in the form of a projection on a flat plane of the nozzle unit, the coil spring is sized to have substantially the same outer dimension as that of the projection, and is disposed to extend between the projection and the ground contact along a straight line passing through the projection, and the inkjet head further comprises a guide externally fitted with the first cylindrical member, the guide being disposed on the flat plane so as to extend substantially coaxially with the straight line, and so as to externally and laterally surround the projection.

12. The inkjet head according to claim 7, wherein the movement limiter comprises a ground-contact-side member disposed at or near the ground contact for limiting movement of the other end of the coil spring.

13. The inkjet head according to claim 12, wherein the ground-contact-side member comprises a recessed portion formed in the ground contact into which the other end of the coil spring is fitted.

14. The inkjet head according to claim 13, wherein the recessed portion is electrically conductive.

15. The inkjet head according to claim 14, wherein the recessed portion is annular shaped with a continuous cross section and is dimensioned so as to accommodate a diameter of the coil spring.

16. The inkjet head according to claim 14, wherein the recessed portion is annular shaped with a non-continuous cross section and is dimensioned so as to accommodate a diameter of the coil spring.

17. The inkjet head according to claim 12, wherein the ground-contact-side member comprises a projecting portion formed in the ground contact which is fitted into the other end of the coil spring.

18. The inkjet head according to claim 17, wherein the projecting portion is electrically conductive.

19. The inkjet head according to claim 7, wherein the movement limiter comprises a second cylindrical member which extends from the vicinity of the earth contact to the vicinity of the ground contact, and into which the coil spring is inserted.

20. The inkjet head according to claim 19, wherein the second cylindrical member is electrically insulative.

21. The inkjet head according to claim 7, wherein the movement limiter comprises a third cylindrical member which extends from the vicinity of the ground contact to the vicinity of the earth contact, and into which the coil spring is inserted.

22. The inkjet head according to claim 1, wherein the nozzle unit and the support are each electrically held at the reference potential to avoid the ink within the nozzle unit from being electrically charged.

23. The inkjet head according to claim 1, wherein the movement limiter is electrically insulative and is disposed in mechanical engagement with the elastic member at the first and second portions and a middle portion of the elastic member, to thereby limit lateral movement of the elastic member.

24. The inkjet head according to clam 1, further comprising an electrically conductive head holder on which the nozzle unit and the printed circuit board are mounted.

* * * * *